US010071894B2

(12) United States Patent
Goncalves

(10) Patent No.: US 10,071,894 B2
(45) Date of Patent: Sep. 11, 2018

(54) OSCILLATION DAMPING FOR A MATERIAL HANDLING VEHICLE

(71) Applicant: The Raymond Corporation, Greene, NY (US)

(72) Inventor: Fernando D Goncalves, Vestal, NY (US)

(73) Assignee: The Raymond Corporation, Greene, NY (US)

( * ) Notice: Subject to any disclaimer, the term of this patent is extended or adjusted under 35 U.S.C. 154(b) by 87 days.

(21) Appl. No.: 15/226,079

(22) Filed: Aug. 2, 2016

(65) Prior Publication Data

US 2017/0036898 A1 Feb. 9, 2017

Related U.S. Application Data

(60) Provisional application No. 62/200,176, filed on Aug. 3, 2015.

(51) Int. Cl.

| | |
|---|---|
| ***B66F 9/20*** | (2006.01) |
| ***B66F 9/075*** | (2006.01) |
| ***B66F 9/12*** | (2006.01) |
| ***B66F 9/07*** | (2006.01) |

(52) U.S. Cl.

CPC ..... *B66F 9/20* (2013.01); *B66F 9/0755* (2013.01); *B66F 9/122* (2013.01); *B66F 9/07* (2013.01)

(58) Field of Classification Search

CPC ..... B66F 9/20; B66F 9/0755; B66F 9/122; B66F 9/07

See application file for complete search history.

(56) References Cited

U.S. PATENT DOCUMENTS

| | | | | |
|---|---|---|---|---|
| 4,305,123 | A * | 12/1981 | Scibor-Rylski | B66F 9/0755 318/601 |
| 4,509,127 | A | 4/1985 | Yuki et al. | |
| 5,157,701 | A * | 10/1992 | Parker | G05B 19/0423 377/39 |
| 6,226,558 | B1 | 5/2001 | Schneider et al. | |
| 7,165,652 | B2 | 1/2007 | Allerding et al. | |
| 7,967,335 | B2 * | 6/2011 | Bergmeier | B66F 9/07559 180/210 |
| 8,229,642 | B2 | 7/2012 | Post, II et al. | |
| 8,230,976 | B2 * | 7/2012 | Baldini | B62B 3/0612 187/226 |
| 9,002,557 | B2 | 4/2015 | Goncalves et al. | |

(Continued)

FOREIGN PATENT DOCUMENTS

| | | | |
|---|---|---|---|
| DE | 3210951 | A1 | 10/1983 |
| DE | 102008020592 | A1 | 10/2009 |

(Continued)

OTHER PUBLICATIONS

EP2881358; Machine Translation; 12 pages.

(Continued)

*Primary Examiner* — Frederick M Brushaber

(74) *Attorney, Agent, or Firm* — Quarles & Brady LLP

(57) ABSTRACT

Various embodiments provide a material handling vehicle (MHV) and associated method provide for damping of mast oscillations of a mast of the MHV. In one approach, mast oscillations can be detected and/or anticipated and a countering force can be generated by an elevated reach actuator of the MHV to damp the oscillations.

15 Claims, 8 Drawing Sheets

(56) References Cited

U.S. PATENT DOCUMENTS

| | | | | |
|---|---|---|---|---|
| 9,290,366 | B2 * | 3/2016 | Jones, Jr. | B66F 9/22 |
| 9,302,893 | B2 | 4/2016 | Goncalves et al. | |
| 9,376,297 | B2 * | 6/2016 | Hoock | B66F 9/10 |
| 2006/0089778 | A1 * | 4/2006 | Lindsay | B62B 3/0612 701/70 |
| 2006/0280585 | A1 * | 12/2006 | Passeri | B66F 9/10 414/667 |
| 2008/0257651 | A1 * | 10/2008 | Williamson | B66F 9/082 187/224 |
| 2009/0312875 | A1 | 12/2009 | Lehtonen et al. | |
| 2012/0239262 | A1 | 9/2012 | Reinert et al. | |
| 2014/0277958 | A1 * | 9/2014 | Yahner | B66F 9/0755 701/50 |
| 2015/0098780 | A1 | 4/2015 | Robolotti et al. | |

FOREIGN PATENT DOCUMENTS

| | | | |
|---|---|---|---|
| DE | 102008020593 | A1 | 10/2009 |
| DE | 102008020595 | A1 | 10/2009 |
| DE | 102013100191 | A1 | 7/2014 |
| EP | 1975114 | A1 | 7/2008 |
| EP | 2881358 | A1 | 10/2015 |
| WO | 2006113364 | A2 | 10/2006 |

OTHER PUBLICATIONS

DEW3210951; Machine Translation; 14 pages.
Zimmert et al, Active Damping Control for Bending Oscillations of a Forklift Mast using Flatness based Techniques; 2010 American Control Conference, Jun. 30-Jul. 2, 2010; pp. 1538-1543.
DE 102008020593; Machine Translation; 5 pages.
DE 102008020595; Machine Translation; 7 pages.
DE 102008020592; Machine Translation; 12 pages.
DE 102013100191; Machine Translation; 11 pages.
EP 1975114; Machine Translation; 8 pages.
Kullaa, Jyrki; Active Control of a Mast Structure Using Support Excitation; ECCOMAS 2004; pp. 1-14.

* cited by examiner

700

OSCILLATION DAMPING FOR A MATERIAL HANDLING VEHICLE

CROSS-REFERENCES TO RELATED APPLICATIONS

The present application is based on, claims priority to, and incorporates herein by reference in its entirety, U.S. Provisional Patent Application No. 62/200,176, filed Aug. 3, 2015, and entitled "Oscillation Damping For A Material Handling Vehicle."

STATEMENT REGARDING FEDERALLY SPONSORED RESEARCH

Not Applicable.

BACKGROUND

The present invention relates to material handling vehicles, and more particularly to systems and methods for mast oscillation damping for material handling vehicles.

Material handling vehicles (MHV), such as lift trucks, forklift trucks, reach trucks, turret trucks, side loader trucks, counterbalanced lift trucks, pallet stacker trucks, orderpickers, transtackers, and man-up trucks, can be commonly found in warehouses, factories, shipping yards, and, generally, wherever pallets, large packages, or loads of goods can be required to be transported from place to place.

Often, MHVs can be high-lift vehicles that can be capable of manipulating loads at higher elevations. Undesirable oscillations may occur in the mast or other vertical weight-bearing portion of high-lift vehicles when operating at high elevations. For example, mast oscillations may be caused by accelerating or decelerating the body 102 and/or raising or lowering a load on a fork assembly when the MHV can be operating at higher elevations. These mast oscillations can increase the time required to pick a load from a rack or to place a load onto a rack as an operator of a manned MHV may have to wait until the oscillations cease or can be small enough as to enable accurate picking or placing of the load. Additionally, mast oscillations can, in some instances, increase wear on the MHV.

A previous solution for reducing mast oscillations utilizes the traction system to introduce counter impulse forces in the traction system to cancel mast oscillations. The traction motor accelerates or decelerates in forward or backward directions to cancel the mast oscillations. However, in such an approach, the perturbations imposed by the traction motor will cause the MHV to move fore and aft in conflict with a position hold algorithm. This can cause the MHV to move to a position away from where the operator intended the MHV to remain.

Another previous solution for reducing mast oscillations utilizes reach actuators of a moving-mast type reach MHV to move the entire vertical mast fore and aft to damp mast oscillations. However, such an approach can be not applicable for reach trucks that utilize a pantograph- or scissor-type reach mechanism instead of moving mast. Further, in a reach truck application setting, such a previous approach provides an inefficient control mechanism in that oscillations induced by a load or assembly situated at the top of a mast can be controlled by movements at the bottom of the mast.

Though suitable for some application settings, such previous solutions do not meet the needs of all application settings and/or users. For example, a desire may exist for an oscillation reduction mechanism that overcomes the aforementioned issues by, in certain embodiments, enabling its corresponding use with position hold algorithms and by enabling oscillation reduction with scissor-type reach trucks.

SUMMARY OF THE INVENTION

Pursuant to various embodiments disclosed herein, a material handling vehicle (MHV) and associated method can be provided for damping of mast oscillations of a mast of the MHV. In at least one embodiment, mast oscillations can be detected and/or anticipated and a countering force can be generated by one or more mechanisms of the MHV to damp the oscillations. In one approach, an elevated reach mechanism of the MHV can be actuated to damp the oscillations. In another approach, a traction system of the MHV can be activated to generate movement of the MHV to damp the mast oscillations.

In one aspect, the present invention provides a method for damping mast oscillations on a reach truck. The reach truck includes at least one traction wheel, a telescoping mast, a fork assembly moveably attached to the telescoping mast by a reach actuator, and one or more sensors arranged adjacent to a top of the telescoping mast and configured to measure oscillations adjacent to the top of the telescoping mast. The method includes determining if the reach truck is being commanded to travel, and upon determining that the reach truck is not being commanded to travel, acquiring data from the one or more sensors arranged adjacent to the top of the mast. The method further includes determining if the data acquired by the one or more sensors indicates an undesired mast oscillation occurring at the top of the telescoping mast, and upon determining that the undesired mast oscillation is occurring at the top of the mast, actuating the reach actuator in a desired direction thereby damping the undesired mast oscillation.

The foregoing and other aspects and advantages of the invention will appear from the following description. In the description, reference can be made to the accompanying drawings which form a part hereof, and in which there can be shown by way of illustration a preferred embodiment of the invention. Such embodiment does not necessarily represent the full scope of the invention, however, and reference can be made therefore to the claims and herein for interpreting the scope of the invention

DESCRIPTION OF DRAWINGS

The invention will be better understood and features, aspects and advantages other than those set forth above will become apparent when consideration can be given to the following detailed description thereof. Such detailed description makes reference to the following drawings.

DETAILED DESCRIPTION OF THE INVENTION

Various embodiments of the present disclosure provide systems and methods for reducing oscillations in a mast of a material handling vehicle (MHV). These oscillations may be caused by manipulation of a load at high elevations or acceleration/deceleration of the MHV itself while a load can be at higher elevations. Generally, in various embodiments, mast oscillations can be detected and/or anticipated and can be reduced through operation of a reach mechanism, a traction control motor, or a combination thereof In certain embodiments, the mast oscillation reduction concept can be combined with a position hold feature to ensure integral operation so that the goals of each feature (e.g., oscillation reduction and position hold) can be realized. Implementation of oscillation reduction according to the embodiments disclosed herein provides solutions not previously realized or utilized for pantograph- or scissor-type reach trucks. Further, when combined with a position hold feature to form a smart position hold feature, the goals of each feature can be realized. Cycle time for MHVs may be reduced in that the oscillations can be reduced, thereby enabling an operator to pick or place a load quickly without the need to wait for mast oscillations to subside. Further, wear on the mast and other portions of the MHV may be decreased.

Figure 1:
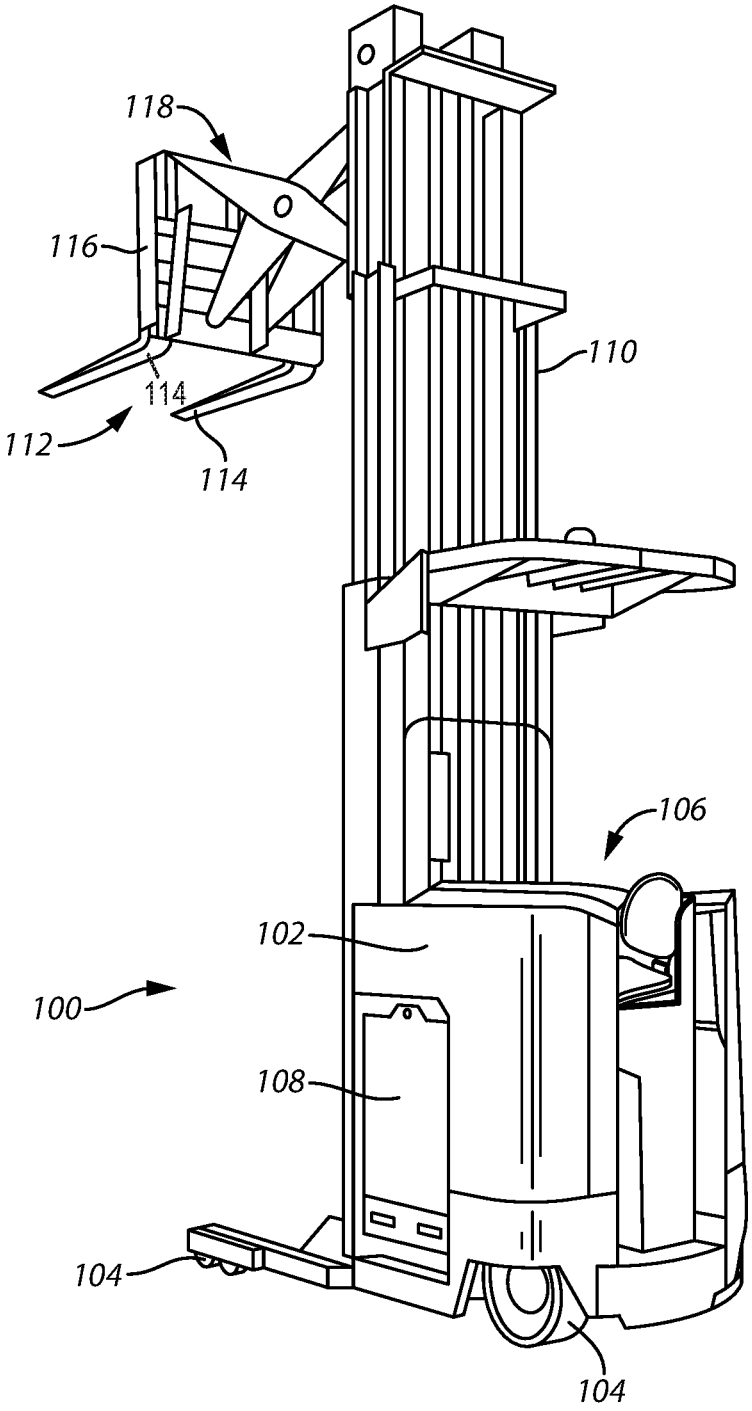
FIG. 1 is a perspective view of a material handling vehicle in accordance with various embodiments of the present invention.

These and other benefits may become clear upon making a thorough review and study of the following detailed description. Referring now to the drawings, and in particular to FIG. 1, one embodiment of an MHV incorporating various aspects of the present invention can be shown. The example MHV 100 (shown here as a reach truck) includes a body 102 having a plurality of wheels 104 and defining an operator compartment 106 including one or more controls and/or displays. The body 102 may accommodate a battery 108 or other power source and may house one or more motors (not shown). The MHV 100 may include a mast 110 coupled to the body 102 for raising and lowering a fork assembly 112 (or, in other embodiments, a platform, an operator cabin, or other assemblies). That is, the mast 110 can be in the form of a telescoping mast with the fork assembly 112 attached thereto such that the fork assembly 112 can be selectively raised and lowered by the mast 110. The fork assembly 112 may include one or more forks 114 for engaging a pallet or other load and a support assembly 116. The illustrated fork assembly 112 can include a pair of forks 114. In various embodiments, the fork assembly 112 can be coupled to the mast 110 by a reach actuator 118. The illustrated reach mechanism can be a pantograph-style or scissor-style reach actuator.

Figure 2:
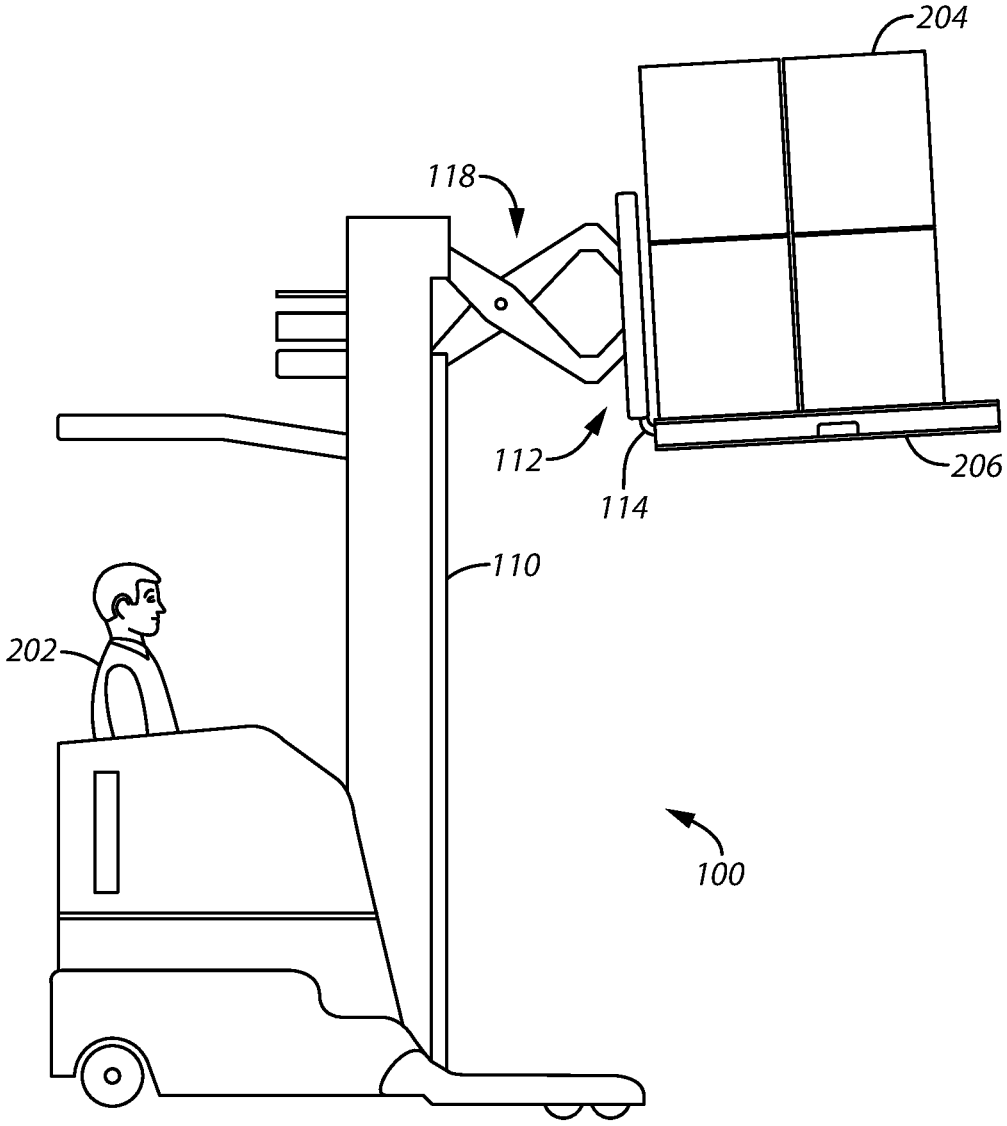
FIG. 2 is another view of a material handling vehicle in accordance with various embodiments of the present invention.

FIG. 2 illustrates an MHV 100 being operated in accordance with various embodiments of the present invention. In one approach, the MHV 100 can be operated by an operator 202 and can be capable of picking, placing, transporting, or otherwise manipulating a load 204, possibly including a pallet 206. As shown in FIG. 2, the operator 202 controls the MHV 100 so that the forks 114 of the fork assembly 112 engage the pallet 206 carrying a load 204. In so doing, the operator 202 may extend or retract the reach actuator 118 to pick, place, engage, or otherwise manipulate the load 204. That is, the reach actuator 118 can be configured to extend the fork assembly 112 away from the mast 110 and retract the fork assembly 114 towards the mast 110. Further, the fork assembly 112 and thereby the load 204 may be raised or lowered by the mast 110. Once the load 204 can be situated on the fork assembly 112, the operator 202 can move the load 204 to another location as needed. In certain embodiments, a human operator 202 may be replaced with an automated controller to comprise a fully-automated system (i.e., an autonomously guided material handling vehicle).

Figure 3:
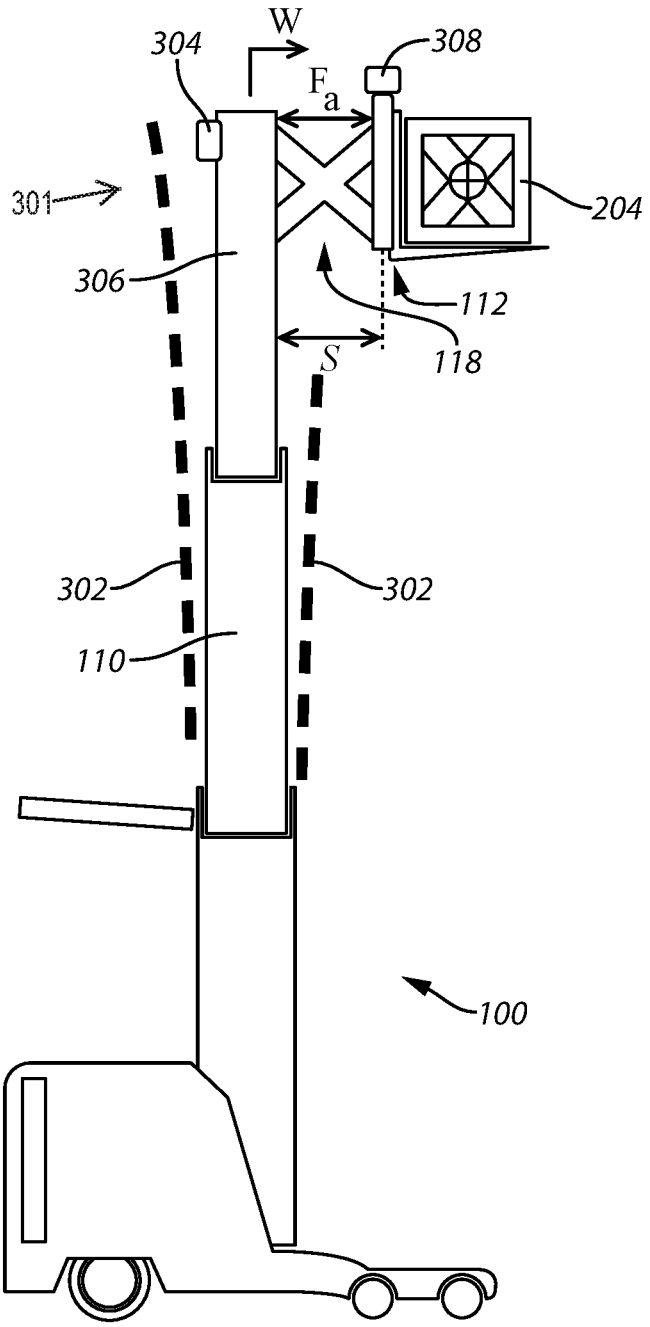
FIG. 3 is a schematic view of a material handling vehicle illustrating a mast oscillation damping technique in accordance with various embodiments of the present invention.

FIG. 3 illustrates an MHV 100 operating in a high-lift condition. As shown in FIG. 3, the mast 110 can be extended to a high-lift configuration to manipulate the fork assembly 112 and the load 204 at high elevations. In some instances, the fork assembly 112 and the load 204 can be considered to be at a high elevation (i.e., the MHV 100 is operating in a high-lift condition) when the mast 110 is extended at or above two-thirds of its maximum evaluated height. In some other instances, the fork assembly 112 and the load 204 can be considered to be at a high elevation when the mast is extended at or above one half of its maximum evaluated height. While the MHV 100 is operating in the high-lift condition, a mast deflection W may be exerted upon the mast 110 with heavy loads 204. Mast oscillation 302 may exist due to flexing of materials in the MHV (e.g. steel in the mast 110), tolerances used in its construction, flexing of an MHV suspension, or wear over time. Mast oscillations 302 can be induced in many ways. For example, in the illustrated high-lift condition, as the fork assembly 112 can be extended or retracted by operation of the reach actuator 118, the force exerted on the mass of the fork assembly 112 and any load 204 (including a pallet 206, if applicable) will create an equal and opposite force on at a top 301 of the mast 110. That is, when the fork assembly 112 and the load 204 can be accelerated or decelerated by the reach actuator 118, a force can be exerted on the mast 110 in a direction opposite to the direction in which the fork assembly and the load 204 can be being accelerated or decelerated. For example, if the fork assembly 112 and load 204 can be retracted toward the mast 110 by the reach actuator 118, a force in the forward direction (i.e., a direction away from the top 301 of the mast 110 and toward the load 204) will be exerted on the top 301 of the mast 110, as the inertia (e.g., stationary inertia) of the load 204 will resist the rearward acceleration. This forward force exerted on the mast 110 can induce the undesired oscillations 302 during loading or unloading events in high-lift conditions (e.g., when a load can be loaded onto or taken off a rack). A similar but opposite effect can occur as the reach actuator 118 can be extended to push the load 204 forward, or away from the mast 110.

In other examples, as the entire MHV 100 begins to move or stop moving through acceleration or deceleration caused by the wheels 104, the load 204 will attempt to remain at its current velocity (e.g., stopped or moving). Thus, acceleration or deceleration of the entire MHV 100 will be countered by forces exerted by the load 204 on the top 301 of the mast 110, which forces can cause undesired oscillations 302 of the mast 110. For example, if the MHV 100 can be stopped with the load 204 stationary in a high-lift condition, as the MHV begins to accelerate forward, the inertia of the load 204 (e.g., stationary inertia) will exert a rearward force on the mast 110, possibly causing oscillations 302. Similarly, if the MHV 100 can be moving in a high-lift condition and subsequently begins to decelerate, the inertia (e.g., forward) will exert a forward force on the mast 110 as the MHV 100 decelerates, possibly causing oscillations 302.

The systems and methods described herein can enable the MHV 100 to actively detect and damp mast oscillations 302 in high-lift conditions. Oscillation detection may be achieved through a variety of detection mechanisms including, for example, using continuous and/or absolute velocity or relative velocity feedback from the mast 110 and/or the fork assembly 112. In other embodiments, for example, a mast accelerometer 304 may be placed on or within an inner telescoping member 306 of the mast 110 (which is, in certain embodiments, the highest telescoping member of the mast 110), as shown in FIG. 3. The mast accelerometer 304 can be configured to detect accelerations of the top 301 of the mast 110. In certain approaches, the mast accelerometer 304 may be placed at or near the top of the inner telescoping member 306 to provide the highest value of acceleration data during mast 110 oscillations. Other locations may be suitable for the mast accelerometer 304 however, and can be fully contemplated by this disclosure. Alternatively or additionally, a fork accelerometer 308 may be placed on or within the fork assembly 112 to detect accelerations of the fork assembly 112. One or both of the accelerometers 304 and 308 may be used, and each may comprise multiple accelerometers within a single assembly and/or spread throughout the mast 110 and/or fork assembly 112 or placed elsewhere as needed. The accelerometers 304 and 308 may be configured to sense acceleration (and deceleration) in any direction, or in some embodiments, acceleration only in fore and aft directions (i.e., directions towards and away from the mast 110). In some embodiments, the MHV 100 can determine acceleration and deceleration of both the mast 110 and the fork assembly 112 with one accelerometer 304 or 308 placed on either the mast 110 or the fork assembly 112 with the added knowledge of a distance and/or a rate of change in distance (indicated as distance S in FIG. 3) between the mast 110 and fork assembly 112 caused by the reach actuator 118. Although accelerometers can be described herein, other sensor types may be applicable and useful in various application settings and the present disclosure can be not limited to the use of accelerometers. For example, high-resolution global positioning satellite, lasers, cameras, proximity sensors, tilt sensors, strain gauges, stress sensors, fiber optic sensors, or any other sensor that can generally detect motion, forces, and/or position of various elements or aspects of the MHV 100 (e.g., distance 5, height of the fork assembly, etc.) may be utilized to detect mast oscillations 302.

Mast oscillations 302 may be detected by detecting periodic accelerations or decelerations, for example, by the accelerometers 304 and/or 308. In some embodiments, the detected periodic accelerations may be checked against one or more instructed operations by an operator 202 to determine if the detected oscillations can be undesired mast oscillations 302. For example, if the operator can be not commanding the MHV 100 to move (i.e., the MHV 100 should be stationary), but oscillations can be detected, a processing device 708 (see FIG. 7) of the MHV 100 may determine that the detected oscillations can be undesired mast oscillations 302. The processing device 708 may distinguish undesired mast oscillations 302 from otherwise desired or instructed movements. Other methods of determining the presence of undesired mast oscillations 302 may be utilized as well. For example, in one approach, mast oscillations 302 could be detected with a strain gage on the mast 110 monitoring the strain exerted on the mast 110. The measured strain may be proportional to the mast deflection. In another example, the MHV 100 can monitor the pressure in the lift cylinders coupled to the mast 110 and configured to raise and lower the mast 110, as mast oscillations 302 can manifest as pressure waves in the lift cylinders.

In another embodiment, the MHV 100 can distinguish undesired mast oscillations 302 from other intended movements. In one embodiment, the MHV 100 may assume that motion of the mast 110, the fork assembly 112, or the load 204 relative to the body 102 can be undesirable motion (e.g., a mast oscillation 302). In another embodiment, the MHV 100 may associate movement of the mast 110, the fork assembly 112, or the load 204 relative to the body 102 to be undesired mast oscillations 302 when the MHV 100 can be stationary, stopped, or when the MHV 100 can be not accelerating (e.g., at a steady pace). In another embodiment, the MHV 100 may consider movement of the mast 110, the fork assembly 112, or the load 204 (e.g., relative to the body 102) that can be unexpected to be undesired mast oscillations 302. For example, the MHV 100 may expect the mast 110 to deflect backwards to some extent when the MHV 100 begins accelerating forward. However, if and when the mast 110 deflects back forward during or after such forward acceleration, the MHV 100 may consider such a movement to be an undesired mast oscillation 302. In another embodiment, the MHV 100 may detect motion of the mast 110, the fork assembly 112, or the load 204 having a repeating periodicity or frequency, which may serve as an indication of a mast oscillation 302. The detected frequency or motion may be an expected oscillation frequency, for example, based on the extended height of the mast, the weight of the load 204, and/or the weight of other assembles, or the frequency of motion may be unexpected. Many other methods of determining the occurrence of undesired mast oscillations 302 may exist, as well, which can be contemplated by this disclosure.

In accordance with various embodiments disclosed herein, relative movement between the mast 110 and body 102 can be controlled through a control algorithm and various hardware elements effecting operation of the control algorithm. With continued reference to FIG. 3, in accordance with various embodiments, once undesired mast oscillations 302 can be detected, a corrective force $F_a$ can be applied between the mast 110 and the fork assembly 112 (with or without a load 204) to reduce (i.e., damp) or eliminate oscillations 302. The corrective force $F_a$ may be applied by the reach actuator 118 to damp or eliminate unwanted mast oscillations 302. For example, if the mast 110 and the fork assembly 112 can be oscillating 302 forward and backward, as the mast 110 and the fork assembly 112 move forward from a rear-flexed position, the reach actuator 118 can retract in an attempt to damp or stop the oscillations 302 of the mast 110. This retraction may be performed by the reach actuator 118 absorbing and slowing the forward motion of the mast 110 relative to the fork assembly 112 and the load 204 such that a small amount of rearward force may be applied to the mast 110 and no additional forward force can be applied to the mast 110. For example, if a very heavy load 204 can be placed on the fork assembly 112, the comparatively high inertial load of the load 204 (e.g., its strong tendency to remain stationary as compared to that of the mast 110) can be used to damp the mast oscillations 302.

Similarly, though in an opposite manner, as the mast 110 and the fork assembly 112 move rearward from a forward-flexed position during undesired mast oscillations 302, the reach actuator 118 can extend in an attempt to absorb and slow/stop the oscillations 302 of the mast 110. Similarly still, as the mast 110 and the fork assembly 112 move forward from a central position toward a forward-flexed position, the reach actuator 118 can retract while exerting a rearward force on the mast 110 away from the fork assembly 112 in an attempt to damp or stop the oscillations 302 of the mast 110. Moreover, as mast 110 and the fork assembly 112 move rearward from a central position toward a rearward-flexed position, the reach actuator 118 can extend while exerting a forward force on the mast 110 toward from the fork assembly 112 in an attempt to damp or stop the oscillations 302 of the mast 110. Any combination of the above described extensions and/or retractions or other variations can be implemented during various portions of the period of oscillation 302 of the mast 110.

Oscillation reduction or damping may require multiple half-periods (e.g., forward to backward or backward to forward) in order to cease the oscillation. This may be dependent upon many factors, including the amount of oscillation, the height of the fork assembly 112 and load 204, the distance S which the reach actuator 118 can be initially extended, the weight of the load 204, as well as many other factors.

In another embodiment, oscillation anticipation can be utilized. Oscillation anticipation can be used in addition to or in lieu of oscillation detection described above. In various approaches, a processing device 708 (FIG. 7) can anticipate an occurrence of an oscillation and/or the characteristic of an anticipated oscillation based on many factors including the height of the fork assembly 112 and load 204, the distance S which the reach actuator 118 can be extended, the weight of the load 204, a distance delta-S which the reach actuator 118 has been extended or retracted, a change in speed of the MHV 100, an acceleration or deceleration rate of the MHV 100, as well as many other factors. In one embodiment, anticipation of oscillation can be determined upon receiving a command to move or cease moving (or accelerate or decelerate) one or more parts of the MHV 100 by an operator 202 or an automated system. Various corrective forces can be applied nearly immediately upon initiation of a movement that may cause mast oscillations 302 to prevent the oscillations.

In various embodiments, once the mast oscillations 302 have ceased or can be at a low enough amplitude, the reach actuator 118 may return to a previously set distance S slowly so as to not induce additional mast oscillations 302. Alternatively, while oscillations can be being damped, the reach actuator 118 can be constantly adjusted so that when oscillations have ceased, the reach actuator 118 can be set to or close to the originally intended distance S.

Mast oscillation damping using the elevated reach actuator 118 enables a more direct manipulation of the space between the load 204 and the top 301 of the mast 110 to more effectively absorb and damp oscillations. Because the top 301 of the mast 110 and the load 204 can be where oscillations can be primarily generated, direct accelerations of the masses in the load 204 and the top 301 of the mast 110 using an elevated reach actuator 118 results in improved oscillation damping. The present oscillation damping concept can be unlike previous solutions that attempt to damp mast oscillations by my moving the entire mast 110 at its base. A notable difference between previous solutions and the present oscillation damping concept can be that, by moving the entire mast 110, previous solutions have utilized inverted pendulum control dynamics to create the control algorithm used to control the damping of mast oscillations. By moving the reach actuator 118 at the top of the mast 110, the present solution alternatively utilizes a more direct form of control dynamics (i.e., the force is being applied directly to the oscillating portion of the mast 110, opposed to being applied at the bottom of the mast 110 and being translated throughout the mast 110) to create the control algorithm used to damp mast oscillations. One skilled in the art will appreciate that the kinematic relationships between the various components (i.e. the mast 110, the reach actuator 118, and the fork assembly 112) and the dynamic forces needed to damp mast oscillations vary greatly between the two methods.

Furthermore, these previous solutions provide an attenuated relationship between the masses at the top 301 of the mast 110 (e.g., the load 204) and the reach actuator 118 or other control mechanism at the bottom of the mast 110. This can be akin to trying to hold a sledgehammer steady with the weight at top by grabbing the bottom end of the handle. Conversely, if applied to the same sledgehammer, the present mast oscillation damping concept would hold both the weight and the upper end of the sledgehammer handle steady by directly manipulating the acceleration of the heavy hammer head relative to the lighter handle.

The present mast oscillation damping concept can be more efficient in its use of power in that it takes less power and torque to steady a weight directly than remotely through an extended mast 110. Additionally, in previous solutions, when the entire mast is moved at the bottom of the mast, a direct force is applied to the body of the MHV, which can undesirably cause the MHV to move. Another potential benefit of mast oscillation damping using the elevated reach actuator 118 is that by applying the damping force at the top of the mast 110, there are no direct forces applied to the body 102 of the MHV 100, and so the MHV 100 is less likely to move.

In some embodiments, an MHV 100 includes a position hold feature implementing an algorithm to hold the position of the MHV 100 while the load 204 can be being manipulated and the operation is not commanding the MHV 100 to move (e.g., while manipulating a load on a rack). For example, when operating a reach truck, an operator 202 may request a reach or retract command from the reach actuator 118. This command will create an acceleration of the load 204 and the fork assembly 112, which can be manifested as a force on the MHV 100. Under certain circumstances, this force may be large enough to cause the MHV 100 to roll. The position hold feature works to generate an appropriate torque at the traction wheels 104 to restrict overall movement of the MHV 100 relative to the floor. In other circumstances, MHV 100 vehicle may be operating on an inclined surface. In such a case, the position hold algorithm would command a torque at the traction wheels 104 to prevent the MHV 100 from rolling on the inclined surface.

In certain embodiments, the functionality of the above described mast oscillation reduction concept can be combined with the functionality of a position hold algorithm to form a smart position hold algorithm. The smart position hold concept merges the position hold algorithm while simultaneously addressing the oscillations of the mast 110. In one approach, a smart position hold algorithm will use the traction system to hold the position of the MHV 100 within a predefined range 604 (see FIG. 6) while also generating the corrective forces to damp or eliminate mast oscillations 302 using the reach actuator 118.

In one embodiment, when the MHV 100 commands the reach actuator 118 to contract or extend (e.g., to accelerate or decelerate the load 204 and fork assembly 112 relative to the mast 110) to cancel mast oscillations 302, as described with respect to the above mast oscillation reduction concept, a reaction force may be generated and imposed on the MHV 100 as a whole. In anticipation of such a reaction force, the smart position hold algorithm may also generate a torque at the traction motor commensurate with the reaction force to prevent the MHV 100 from moving while the mast oscillations can be being damped. Without this combined smart position hold feature, while oscillation damping occurs through activation of the reach actuator 118, the MHV may move on its wheels. However, the combined smart position hold concept works to integrate the two features to both maintain relative location of the MHV 100 as a whole and to damp mast oscillations 302.

Figure 4:
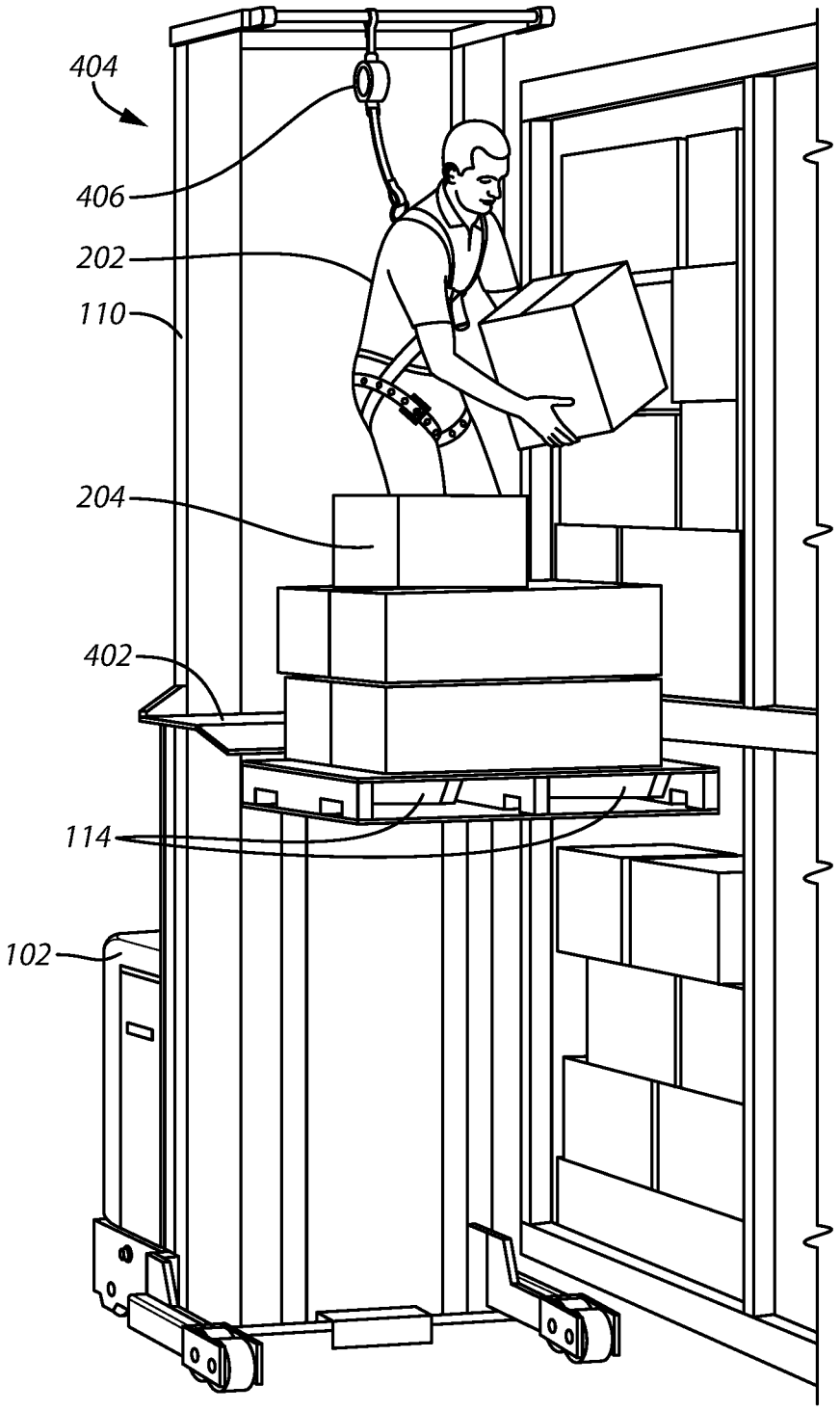
FIGS. 4 is a view of an alternative material handling vehicle in accordance with various embodiments of the present invention.

Turning now to FIG. 4, a second embodiment of an MHV 100 incorporating various aspects of the present invention can be shown. The MHV 100 of FIG. 4 can be a man-up truck 400 such as an orderpicker. The man-up truck 400 includes a user platform 402 and operator compartment 404 that can be elevated up the mast 110. In various embodiments, the orderpicker or another man-up truck 400 may include fall protection 406 such as, for example, a user-wearable harness or belt attached to a, tether, or retractable tether, which can be in turn coupled to a frame portion of the cabin 404. In particular embodiments, the fall protection 406 may comprise a tether and a harness or, alternatively, a retractable tether and a belt, which can be approved combinations under various applicable safety standards. The man-up truck 400 also includes forks 114 (shown here within a pallet) or a platform upon which an operator 202 may place a load 204. Other man-up trucks 400 may include turret trucks, side loader trucks, and other MHVs that elevate the operator 202 along with the load 204. Man-up trucks 400 enable the operator 202 to better see the load 204 while picking or placing the load 204, or enable an operator to manipulate the load by hand at higher elevations. Some man-up trucks 400, including turret trucks, orderpickers, and transtacker trucks, may incorporate a reach actuator 118 as described above and may be fully compatible with the teachings above regarding mast oscillation damping using the reach actuator 118.

Figure 5:
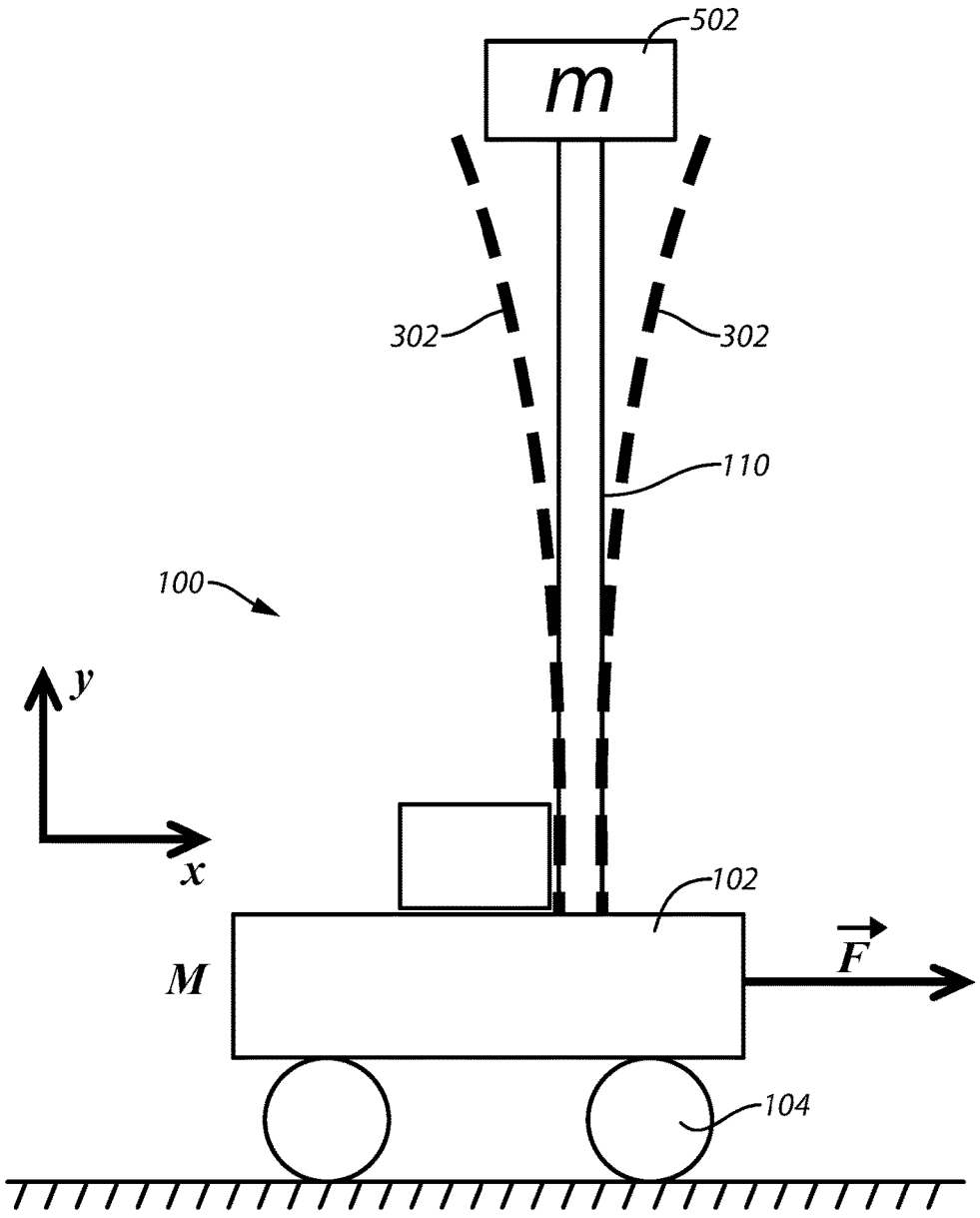
FIG. 5 is a schematic view of a material handling vehicle illustrating a second mast oscillation damping technique in accordance with various embodiments of the present invention.

FIG. 5 illustrates traction-based mast oscillation damping for an MHV 100 according to various aspects of the present invention. In one approach, FIG. 5 illustrates traction-based mast oscillation damping for a man-up truck 400, however, it may illustrate application traction-based mast oscillation damping for any lift truck in lieu of or in addition to oscillation damping using an elevated reach actuator 118.

FIG. 5 includes a schematic representation of an MHV 100 including the body 102, the wheels 104, the mast 110, and a mass 502. The mass 502 may be representative of the center of gravity (CG) for the elevated load, including the mass of the load 204, the mass of the mast 110, and the mass of a fork assembly 112, if applicable. If the illustrated MHV 100 can be a man-up truck, the mass 502 may also be representative of an elevated operator platform 402, an elevated operator cabin 404, and an elevated operator 202. Mast oscillations 302 can be also illustrated and may be caused by manipulation of a load 204, a fork assembly 112, movements of an elevated operator 202, or by acceleration or deceleration of the entire MHV 100 via the wheels 104.

In accordance with the illustrated embodiment in FIG. 5, mast oscillations 302 can be damped using traction-based mast oscillation damping. Upon detecting undesired mast oscillation 302, or alternatively, in anticipation of undesired mast oscillations 302, the MHV 100 can activate the traction motor 726 (see FIG. 7) to move the wheels 104 to accelerate or decelerate the MHV 100 to damp the mast oscillations 302. This acceleration imposes a force F on the MHV 100 which can be translated onto the mast 110 to counter any undesired oscillations 302.

Figure 6:
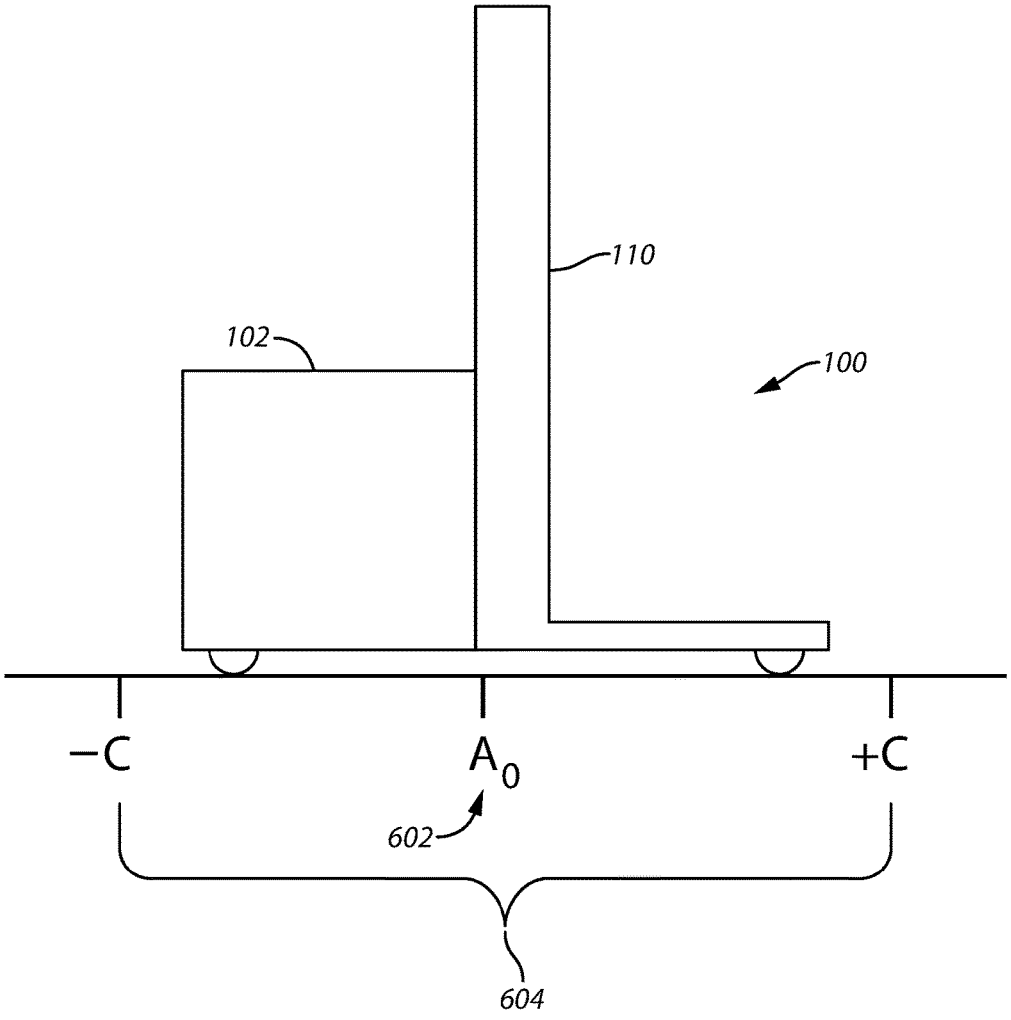
FIG. 6 is a schematic view of a material handling vehicle illustrating a smart position hold technique in accordance with various embodiments of the present invention.

As described above, the MHV 100 may include a position hold feature. Accordingly, an additional embodiment of a smart position hold feature allows for both position hold functionality and traction-based mast oscillation damping. Turning to FIG. 6, this additional embodiment of the smart position hold concept can be illustrated. An MHV 100 can be shown, including the body 102, the wheels 104, and the mast 110. An intended hold position $A_0$ 602 can be shown. Position $A_0$ 602 may represent the center of the MHV 100 (or any other reference point on the MHV 100) at a location where an operator 202 may have stopped movement of MHV 100 and/or intended the MHV 100 to remain. Upon initiation of traction-based mast oscillation damping, the MHV 100 may move away from the position $A_0$ 602 due to movements effected to damp the oscillations.

According to an embodiment, the movement of the MHV 100 during traction-based mast oscillation damping can be confined to be within a range 604 from +C to −C. The range may be defined as an allowable distance which the center of the MHV 100 may be allowed to move away from the intended hold position $A_0$ 602, or may be the limits of movement which the edges of the MHV 100 may be able to travel. The range 604 may be a preset range (e.g., 6 or 12 inches, or any other value as can be suitable in various application settings). Alternatively, the range 604 may be dynamically defined based on any number of factors, including elevation height of the mast 110 and/or load 204, weight of the load 204, speed of the MHV 100 prior to stopping, sensed distance to other obstructions, or any other pertinent factor. The range may be defined by an operator 202 or by another user, for example, to be smaller or wider to accommodate a configuration of a warehouse or other application setting. The range may be symmetrical or asymmetrical about the position $A_0$ 602 and may be dependent upon a given application setting or MHV 100 configuration. The range 602 may be dynamic and include various tiers of progressively larger ranges dependent upon various factors, for example, upon the amplitude of a sensed mast oscillation 302, the weight of a load 204, the height, or other factors.

In one embodiment of a smart position hold feature, after traction-based mast oscillation damping has eliminated or reduced mast oscillations to an acceptable amplitude, and/or while traction-based mast oscillation damping occurs, the MHV 100 may slowly (so as to avoid inducing additional mast oscillations) return to the intended hold position $A_0$ 602 and hold the MHV 100 at the intended hold position $A_0$ 602. Utilizing traction-based mast oscillation damping with a man-up truck MHV 100 may be useful in that an operator 202 positioned up near the load 204 will not feel or otherwise be affected by the movements of the MHV 100 by the traction motor as much as if they were positioned on or near the ground. Efficiency may be improved as an operator may not be required to wait for unwanted mast oscillations 302 to subside before handling goods. Further, as the operator 202 can be also elevated, reduction of unwanted mast oscillations 302 may add to the comfort and confidence of the elevated operator 202.

An MHV 100 implementing the smart hold feature according to various embodiments disclosed herein and including a traction-based mast oscillation damping feature can overcome the shortcomings of previous systems that otherwise have to choose between the conflicting goals of traction-based mast oscillation damping and position hold features. By allowing some movement within the range 604 during traction-based mast oscillation damping and by returning the MHV 100 to the intended hold position $A_0$ 602 at or upon cessation of oscillations, the benefits of both features can be realized.

In some embodiments, either or both types of mast oscillation damping may be utilized in combination with a smart position hold feature. For example, an MHV 100 configured with a reach actuator 118 may also implement traction-based mast oscillation damping either simultaneously with or as an alternative to oscillation damping with the elevated reach actuator 118. In some approaches, an operator 202 or another user may determine a preference for one or both oscillation damping technique, either ahead of time or dynamically as a particular situation requires. In other embodiments, the MHV 100 may utilize a combination of oscillation damping techniques. For example, if a reach actuator 118 can be fully or near-fully extended or fully retracted, oscillation damping may be achieved with traction-based oscillation damping, at least in one direction, instead of with the reach actuator 118. Alternatively, if a traction-based oscillation damping feature has moved the MHV 100 to the edges of the range 604 or senses an obstruction, the MHV 100 may rely more heavily on oscillation damping with the reach actuator 118. Further, if a position hold feature may be given priority over a traction-based mast oscillation damping feature so that the MHV 100 relies exclusively or more heavily on damping with the reach actuator 118. Many other factors can influence the choice between or a balance between a mixture of the two types of oscillation damping. As described, the smart position hold feature can operate with either or both types of the disclosed mast oscillation damping techniques. This may entail returning the MHV 100 to the intended hold position $A_0$ 602 or may entail anticipating additional forces exerted on the MHV 100 through use of oscillation damping with the reach actuator 118.

In various embodiments, it may be useful for the MHV 100 to determine the center of gravity (CG) of the MHV 100. The CG may also be determined with respect to one or all of the mast 110, the fork assembly 112, the operator platform 402, the operator cabin 404, and/or the load 204. In one embodiment, the CG may be estimated as can be described in U.S. Pat. No. 8,140,228 titled "System and Method for Dynamically Maintaining the Stability of a Material Handling Vehicle Having a Vertical Lift," which is hereby incorporated herein by reference. In certain embodiments, a determined CG can be used to assign appropriate gains and/or filter settings to be used by a processing device 708 (see FIG. 7) or other hardware or software to implement an oscillation damping technique as described herein and/or to implement a smart hold feature as described herein. This may allow the MHV 100 to compensate for various factors such as load on the forks 114, elevated height, travel speed, and other factors. In one approach, a determined CG may be used as a virtual sensor to provide feedback to an algorithm implementing the features.

Figure 7:
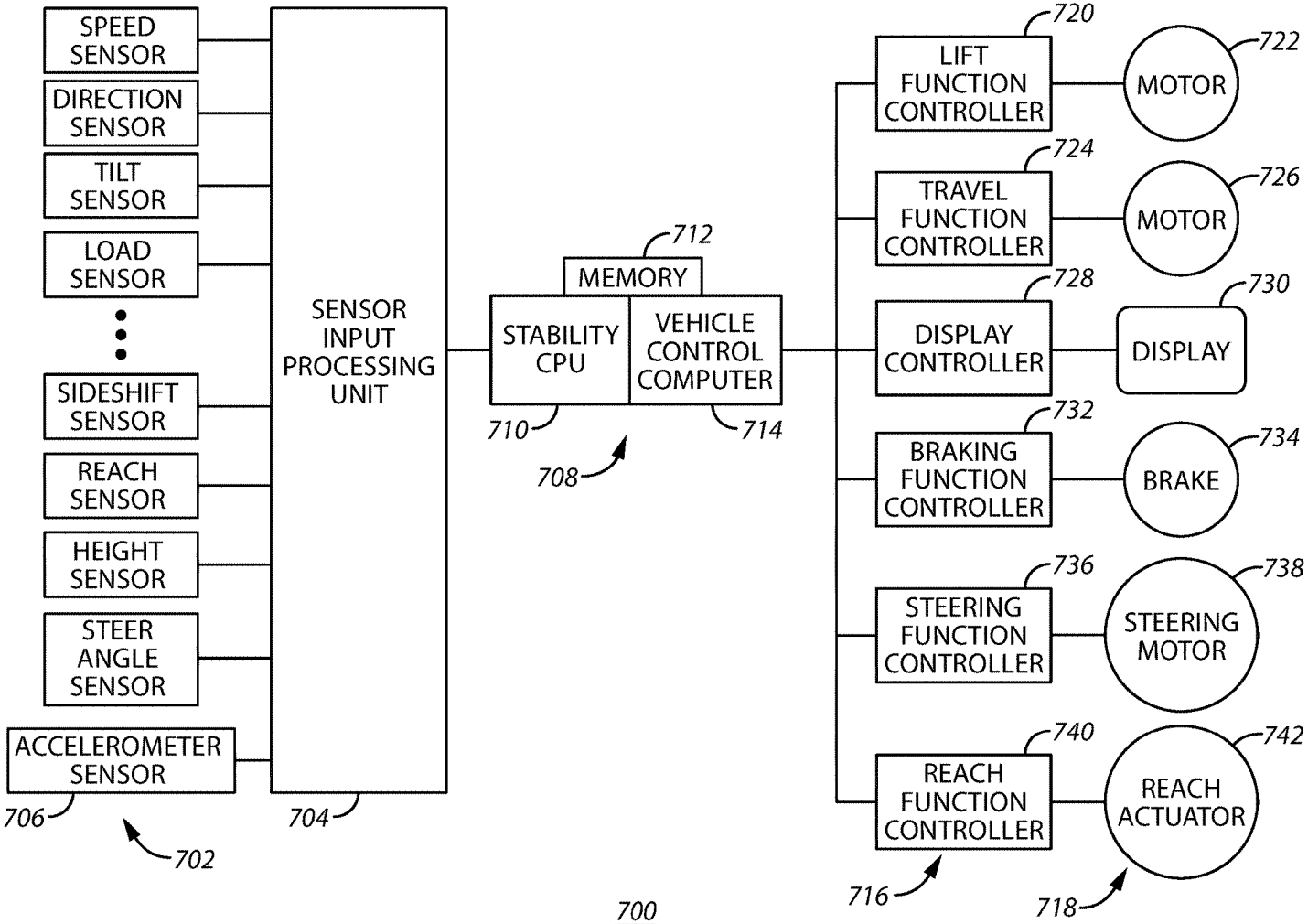
FIG. 7 is block diagram illustrating a control system of the material handling vehicle in accordance with various embodiments of the present invention.

Turning now to FIG. 7, a schematic representation of a control system 700 of an MHV 100 can be illustrated in accordance with various embodiments. The control system 700 may include an array of sensors 702 linked to a sensor input processing circuit 704, which can be together configured to acquire and process signals describing dynamic vehicle properties such as speed, direction, steering angle, floor grade, tilt, load weight, mast height, lift position, sideshift, and acceleration. Various sensed aspects, including body 102 speed, may be available on the MHV's CAN bus. For example, the sensor array 702 may employ a motor controller, tachometer, or encoder to measure vehicle speed; a potentiometer or feedback from a steering control circuit to measure steering angle; a load cell, hydraulic pressure transducer, or strain gauge to measure load weight; an encoder to measure mast height; or three-axis accelerometers to measure tilt, sideshift, reach, and floor grade. In one embodiment, acceleration can be sensed via one or more accelerometer sensors 706, which may further comprise one or more of the mast accelerometer 304 and/or the fork accelerometer 308. The sensor input processing circuit 704 can be coupled to a processing device 708 that may include a stability CPU 710, a vehicle memory 712, and a vehicle control computer 714, which together analyze static vehicle properties and dynamic vehicle properties to assess vehicle stability, including position hold and mast oscillation. The processing device 708 including the stability CPU 710 and the vehicle control computer 714 may comprise modules within a single processing device or may comprise separate processing devices communicatively coupled. Changes to vehicle operating parameters based on the assessed vehicle stability can be communicated from the processing device 708 to function controllers 716, which adjust the operation of vehicle actuators, motors, and display systems 718 to maintain vehicle stability, maintain a smart hold position, and/or to damp mast oscillations. For example, adjusted vehicle operating parameters may be received by a lift function controller 720 that activates a lift motor 722 to change lift position up and down a mast 110; a travel function controller 724 to relay maximum speed limitations and other traction controls (e.g., traction-based mast oscillation damping movements, smart position hold actions, etc.) to a vehicle traction motor 726; a display controller 728 and display 730 to communicate present or pending changes in vehicle operating parameters to an operator 202; a braking function controller 732 and brake 734 to adjust vehicle speed or to aid in a smart position hold feature; and a steering function controller 736 that directs a steering motor 738 to limit or control steering angle. The vehicle control computer 714 may also include or be coupled to a reach function controller 740 to control operation of a reach actuator 742 or reach motor to implement mast oscillation damping with the reach actuator 118. Many variations can be possible.

Figure 8:
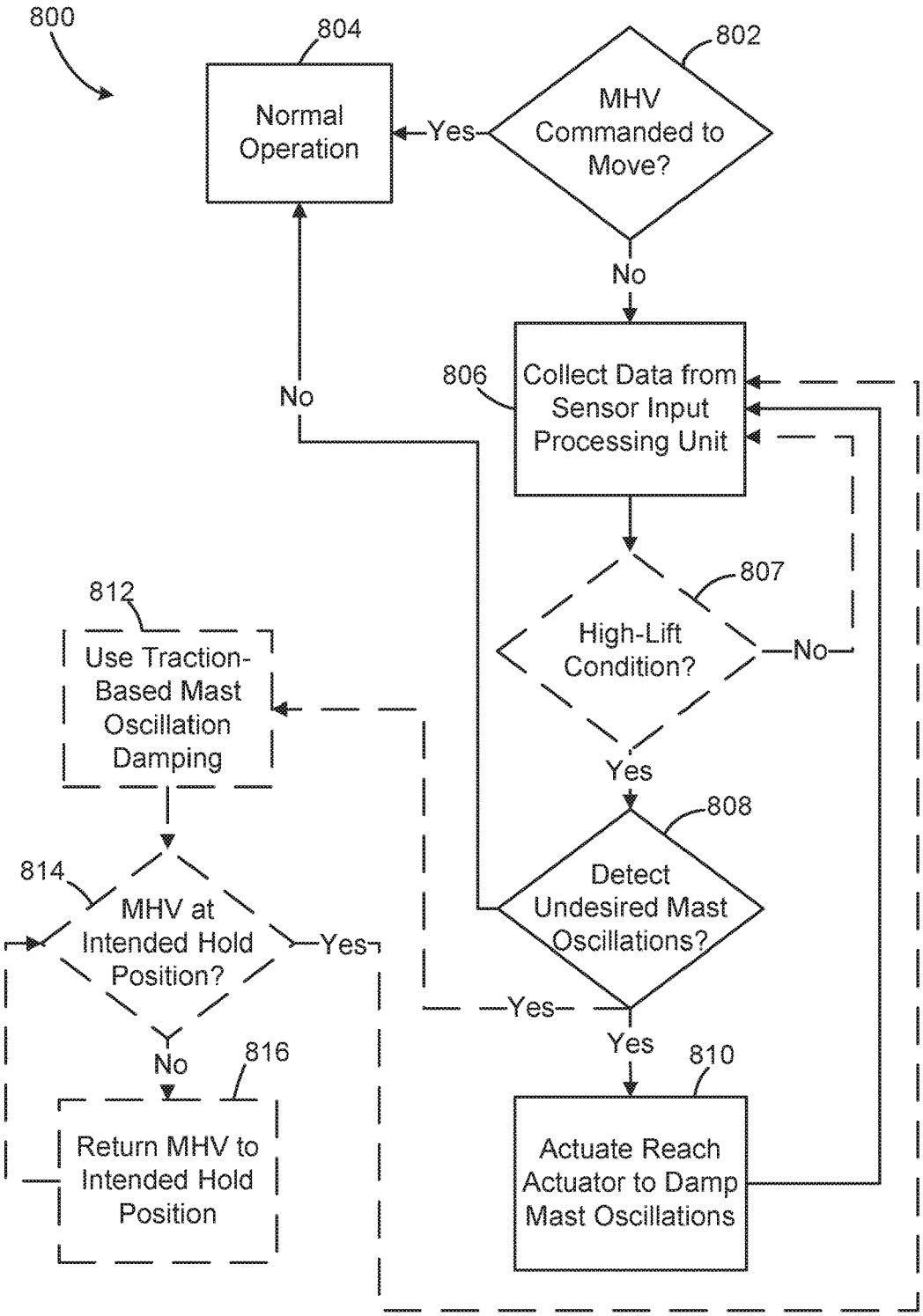
FIG. 8 is a flowchart illustrating steps for damping oscillations in a mast of a material handling vehicle according to various embodiment of the present invention.

FIG. 8 illustrates one non-limiting example of the steps for damping mast oscillations on a MHV while the MHV is in a high-lift condition and the operator is not commanding the MHV to travel according to the present invention. As shown in FIG. 8, initially it can be determined, at step 802, if the MHV 100 is being commanded to travel. If it is determined at step 802 that the MHV 100 is being commanded to move, then the MHV 100 can be under normal operation 804. If it is determined at step 802 that the MHV 100 is not being commanded to move (e.g., when the operator is manipulating a load on a rack in a high-lift condition), then data can be collected from the sensor input processing unit 704 at step 806. When data is collected from the sensor input processing unit 704 at step 806, data can be collected, for example, from the mast accelerometer 304 and/or the fork accelerometer 308. Alternatively or additionally, data may be collected at step 806 from a height sensor in communication with the sensor input processing unit 704. The height sensor can indicate a height of the mast 110. In one non-limiting example, once the data after collecting data at step 806, it can be determined if the MHV 100 is in a high-lift condition at step 807. For example, if the height sensor indicates at step 806 that the mast 100 is at or above two-thirds of its maximum evaluated height, then a high-lift condition can be identified and the process can continue to step 808. If a high-lift condition is not detected at step 807, then the process can continue collecting data at step 806.

The data collected from the mast accelerometer 304 and/or the fork accelerometer 308 can be monitored, and it can be determined if the collected data indicate an undesired mast oscillation at step 808. The detection of undesired mast oscillations at step 808 may comprise determining if a measured oscillation is above a predetermined threshold. Alternatively or additionally, the processes of detecting undesired mast oscillations, described above, may be implemented at step 808. If undesired mast oscillations are not detected at step 808, then the MHV 100 can be under normal operation 804. Conversely, if undesired mast oscillations are detected at step 808, the MHV 100 can be commanded to actuate the reach actuator 118 in a desired direction to damp or eliminate the detected mast oscillations at step 810. The damping or elimination of the mast oscillations via the reach actuator 118 at step 810 may be carried out in accordance with the above-described processes. As shown in FIG. 8, after the reach actuator 118 has been actuated to damp the undesired mast oscillations, the process can return to step 806 and continually monitor for subsequent undesired mast oscillations. Thus, the reach actuator 118 can be used to damp undesired mast oscillations until it is determined that the MHV 100 has returned to normal operation 804 (i.e., operation without any undesired mast oscillations).

Additionally, in some instances, as described above, the traction-based mast oscillation damping may be used in conjunction with the reach actuator 118 mast oscillation damping. In these instances, if undesired mast oscillations are detected at step 808, the traction-based mast oscillation damping can simultaneously be implemented at step 812. As described above, the traction-based mast oscillation damping may cause the MHV 100 to move from the intended hold position $A_0$ 602. As such, after step 812, it can be determined if the MHV 100 has displaced from the intended hold position $A_0$ 602. If the MHV 100 is not at the intended hold position $A_0$ 602, the MHV 100 can be instructed to move to the intended hold position $A_0$ 602 at step 816. If the MHV 100 is at the intended hold position $A_0$ 602, the process can return to step 806. It should be appreciated that although the MHV 100 may move during the traction-based oscillation damping, this movement is not commanded, for example, by an operator. Rather, it can be an automatic movement integrated into a mast oscillation damping algorithm implemented by the processing device 708. It should further be appreciated that the position hold algorithm, described above, may be implemented simultaneously mast oscillation damping approach shown in FIG. 8 to ensure the MHV 100 remains within a predefined displacement range while damping mast oscillations.

So configured, and in accordance with various embodiments, an MHV 100 reduces or damps mast oscillations, which can in turn improve operator productivity. For example, when the mast in a high-lift condition, an operator may be able to pick and/or place a load or pallet more efficiently due to reduced mast oscillations. Reduction of mast oscillations can also improve stability of the load on the forks and can improve cycle times for automated lift trucks. For example, an automated MHV, or an operator of a manned MHV, will be able to spear and/or engage a rack opening quicker when the mast is not oscillating or during reduced mast oscillations. Additionally, engaging a pallet situated in the racks at high elevations can occur quicker when the forks are not oscillating and remain stable. Combining one or both of the disclosed mast oscillation damping techniques (traction-based and/or reach mechanism-based) with a position hold feature into an improved smart position hold feature can ensure the utility of both features can be preserved.

Thus, while the invention has been described in connection with particular embodiments and examples, the invention can be not necessarily so limited, and that numerous other embodiments, examples, uses, modifications and departures from the embodiments, examples and uses can be intended to be encompassed by the claims attached hereto. The entire disclosure of each patent and publication cited herein can be incorporated by reference, as if each such patent or publication were individually incorporated by reference herein.

Various features and advantages of the invention can be set forth in the following claims.

I claim:

1. A method for damping mast oscillations on a reach truck, the reach truck including at least one traction wheel, a telescoping mast, a fork assembly moveably attached to the telescoping mast by a reach actuator, and one or more sensors arranged adjacent to a top of the telescoping mast and configured to measure oscillations adjacent to the top of the telescoping mast, the method comprising:

determining if the reach truck is being commanded to travel by a traction motor;

upon determining that the reach truck is not being commanded to travel by the traction motor, acquiring data from the one or more sensors arranged adjacent to the top of the telescoping mast;

determining if the data acquired by the one or more sensors indicates an undesired mast oscillation occurring at the top of the telescoping mast; and upon determining that the undesired mast oscillation is occurring at the top of the telescoping mast, actuating the reach actuator in a desired direction thereby damping the undesired mast oscillation.

2. The method of claim 1, wherein acquiring data from the one or more sensors arranged adjacent to the top of the telescoping mast comprises:

measuring a first acceleration at the top of the telescoping mast using a mast accelerometer coupled to a top of the telescoping mast.

3. The method of claim 1, wherein acquiring data from the one or more sensors arranged adjacent to the top of the telescoping mast comprises:

measuring a second acceleration at the top of the telescoping mast using a fork assembly accelerometer coupled to the fork assembly.

4. The method of claim 1, further comprising:

detecting, from the acquired data, an acceleration direction of the undesired mast oscillation, wherein the acceleration direction is opposite to the desired direction.

5. The method of claim 1, wherein determining if the data acquired by the one or more sensors indicates an undesired mast oscillation occurring at the top of the telescoping mast comprises:

determining if an acceleration adjacent to the top of the telescoping mast that is above a predetermined acceleration value.

6. The method of claim 1, wherein the reach actuator is a pantograph actuator.

7. The method of claim 1, wherein actuating the reach actuator in a desired direction comprises:

actuating the fork assembly in the desired direction.

8. The method of claim 1, further comprising:

detecting a height of the telescoping mast via a height sensor; and upon detecting the height of the telescoping mast, determining if the reach truck is in a high-lift condition.

9. The method of claim 8, wherein determining if the reach truck is in a high-lift condition comprises:

determining if the detected height of the telescoping mast is greater than to one-half of a maximum extended height.

10. The method of claim 8, wherein determining if the reach truck is in a high-lift condition comprises:

determining if the detected height of the telescoping mast is greater than two-thirds of a maximum extended height.

11. The method of claim 1, further comprising:

determining if the reach truck displaces from an intended hold position.

12. The method of claim 11, further comprising:

upon determining that the reach truck has displaced from the intended hold position, instructing the reach truck to return to the intended hold position.

13. The method of claim 1, further comprising:

monitoring a position of the reach truck relative to an intended hold position; and determining if the position of the reach truck is outside of a predefined range from the intended hold position.

14. The method of claim 13, further comprising:

upon determining that the position of the reach truck is outside of the predefined range from the intended hold position, instructing the reach truck to displace towards the intended hold position.

15. The method of claim 13, wherein monitoring the position of the reach truck relative to the intended hold position comprises:

monitoring a traction position of a traction wheel of the reach truck.

* * * * *